United States Patent [19]

Schulman

[11] 4,244,508

[45] Jan. 13, 1981

[54] SHOE BOX

[75] Inventor: Kenneth B. Schulman, New York, N.Y.

[73] Assignee: Millen Industries, Inc., New York, N.Y.

[21] Appl. No.: 134,498

[22] Filed: Mar. 27, 1980

Related U.S. Application Data

[63] Continuation of Ser. No. 15,300, Feb. 26, 1979, abandoned.

[51] Int. Cl.[3] ..... B65D 5/22

[52] U.S. Cl. ..... 229/34 R; 229/31 FS

[58] Field of Search ..... 229/31 FS, 32, 34 R

[56] References Cited

U.S. PATENT DOCUMENTS

| | | | |
|---|---|---|---|
| 1,667,874 | 5/1928 | Smith | 229/32 |
| 2,024,795 | 12/1935 | Claff | 229/34 R |
| 2,132,776 | 10/1938 | Claff | 229/34 R |
| 2,143,763 | 1/1939 | Claff | 229/34 R |
| 2,634,046 | 4/1953 | Weber | 229/34 R |
| 2,697,546 | 12/1954 | Bergstein | 229/34 R |
| 2,769,588 | 11/1956 | Beck | 229/31 FS |
| 3,477,633 | 11/1969 | Greene et al. | 229/31 FS X |
| 3,743,170 | 7/1973 | Riccio | 229/31 FS X |

*Primary Examiner*—Davis T. Moorhead
*Attorney, Agent, or Firm*—Gottlieb, Rackman & Reisman

[57] ABSTRACT

A box construction is characterized by double-layered side walls and by a paper wrapping extending over the exterior surface of the box and extending partially over each interior side wall and each interior end wall. Each double-layered side wall consists of a single thickness of paperboard, partially covered on one side with paper wrap and folded inwardly over itself, so that the external paper wrap extends over the interior side walls to form a paper lip, giving the interior of the box a desirable "finished" appearance.

2 Claims, 4 Drawing Figures

SHOE BOX

This is a continuation of my copending application Ser. No. 015,300, filed Feb. 26, 1979, now abandoned.

This invention relates to boxes, and more specifically, to an improved box construction in which the interior of the box has a pleasing decorative appearance and is quite sturdy.

In box construction, it has been common practice to cover the exterior surface of the box with a paper wrapper, in order to give the box a decorative appearance. However, the interior of the box has generally remained uncovered, thereby exposing the unsightly cardboard or paperboard material of which the box is constructed.

In recent years, box constructions having single-layered side and end walls, with a double-layered "lip" extending around the entire inside perimeter of the box, have become quite common. Generally, the "lip" is an extension of the outer wall of the box, and is covered with the same wrapper which adorns the exterior of the box. However, the double-layered "lip" generally extends downwardly only about one-half inch or less below the top edge of the box. Accordingly, the remainder of the interior side walls of the prior art boxes are only a single layer thick, and are therefore not strong.

It is therefore the principal object of this invention to provide a box construction having side walls of double thickness from the top of the box to the bottom of the box, thereby enhancing the strength of the box.

A further object of this invention is to provide a box construction, the upper inside perimeter of which carries a paper lip which is an extension of the same paper wrapper which adorns the exterior of the box, thereby giving the interior of the box a desirable "finished" appearance.

Briefly, in accordance with the principles of the present invention, a box is made from a one-piece cardboard blank, one face of which is substantially but not completely covered by a decorative paper wrapper. The blank is cut and creased such that when it is folded into an assembled box, the side walls are of double thickness, and the entire exterior surface presents the decorative paper wrap outwardly. The interior wall surface carries an extension of the paper wrap forming an interior paper "lip", thereby enhancing both the strength and the appearance of the box.

Other objects, features and advantages of this invention will become more readily apparent from an examination of the following specification when taken in conjunction with the accompanying drawings, wherein.

Figure 1:
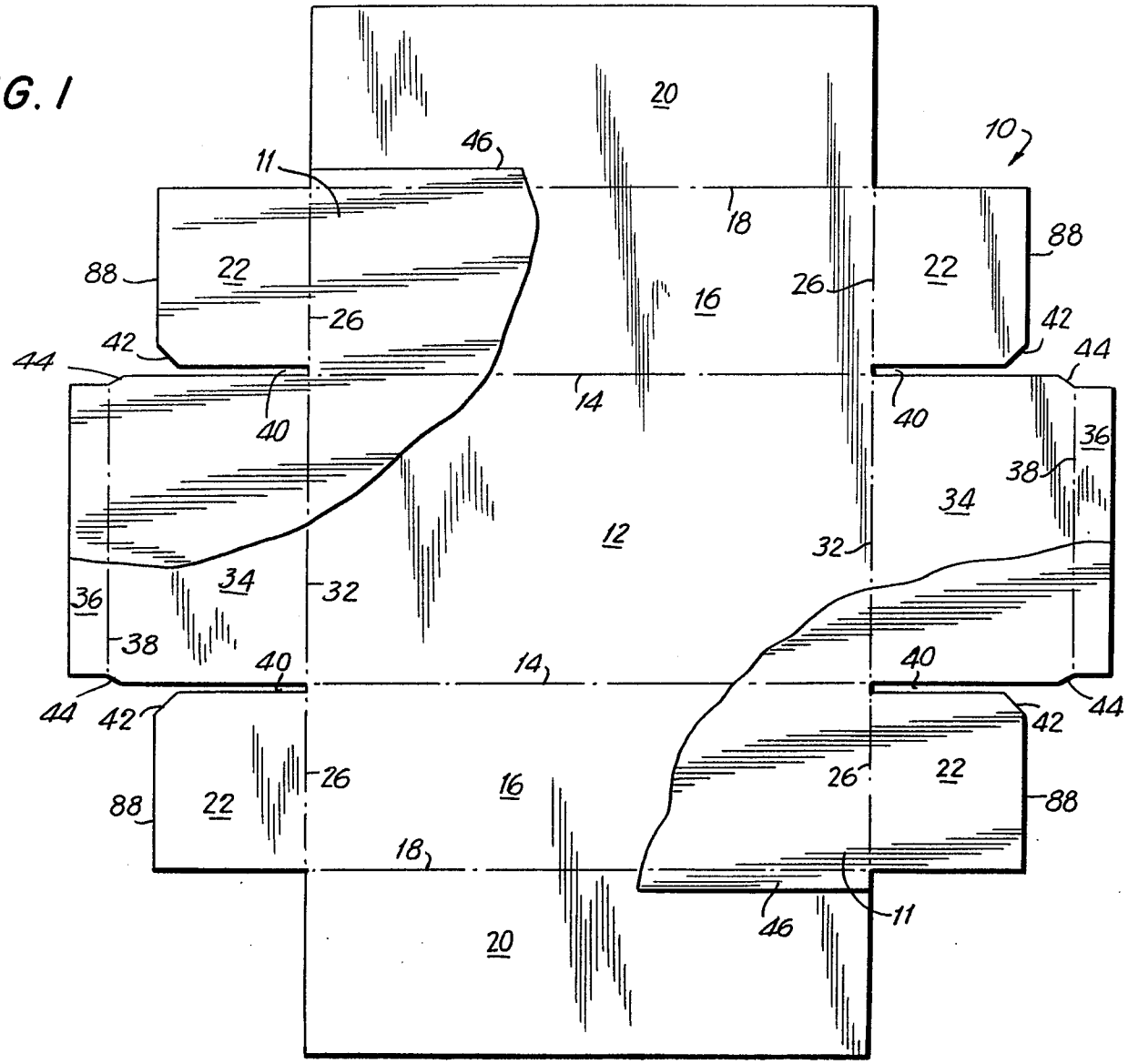
FIG. 1 is a plan view illustrating the preferred form of the pre-cut and pre-creased flat box blank from which the box of the present invention is made.

Referring now to the drawings, and in particular to FIG. 1, the preferred form of a flat box blank for use in accordance with the present invention is generally designated 10. Box blank 10 is generally formed of cardboard or paperboard of any suitable character, preferably being thin and flexible, but also opaque and relatively strong. The upper surface of the box blank 10 is partially covered with a paper wrap 11, preferably bearing a decorative design, and shown partially broken away in FIG. 1. However, the entire reverse side of the blank (not shown) is unornamented. The paper wrap 11 may be formed integrally with the cardboard blank, or may be formed separately, and then cut to the desired dimensions, after which the paper wrap may be attached to the blank in any conventional manner such as with an adhesive.

Box blank 10 is pre-creased to define a central portion 12, which is separated by creases 14 from side panels 16, which are in turn separated by creases 18 from side panel flaps 20. The side panels 16 have attached thereto at both ends thereof extensions 22, which are separated from the side panels 16 by creases 26.

At the ends of central portion 12, but separated therefrom by the creases 32, are end panels 34. Each end panel 34 has an end panel extension 36 of reduced dimension, which is separated therefrom by creases 38.

As shown in FIG. 1, end panels 34 and end panel extensions 36 are separated from side panel extensions 22 by slits 40, which extend from the creases 14 to the edge of the blank 10. The open ends of the slits 40 are formed by the cut-off corners 42 of side panel extensions 22, and by the cut-off corners 44 of end panels 34.

As shown best in FIG. 1, paper wrap 11 is not coextensive with box blank 10, but covers a large portion of the surface of the blank. The only segments of blank 10 not covered entirely by paper wrap 11 are side panel flaps 20. Each side panel flap 20 carries only a narrow edge portion 46 of paper wrap 11, each edge portion 46 being adjacent to and substantially parallel to one of the creases 18. The width of edge portion 46 may vary, but is preferably no more than one-half inch, since, as will appear below, it forms part of the paper lip which adorns the interior walls of the box.

Figure 2:
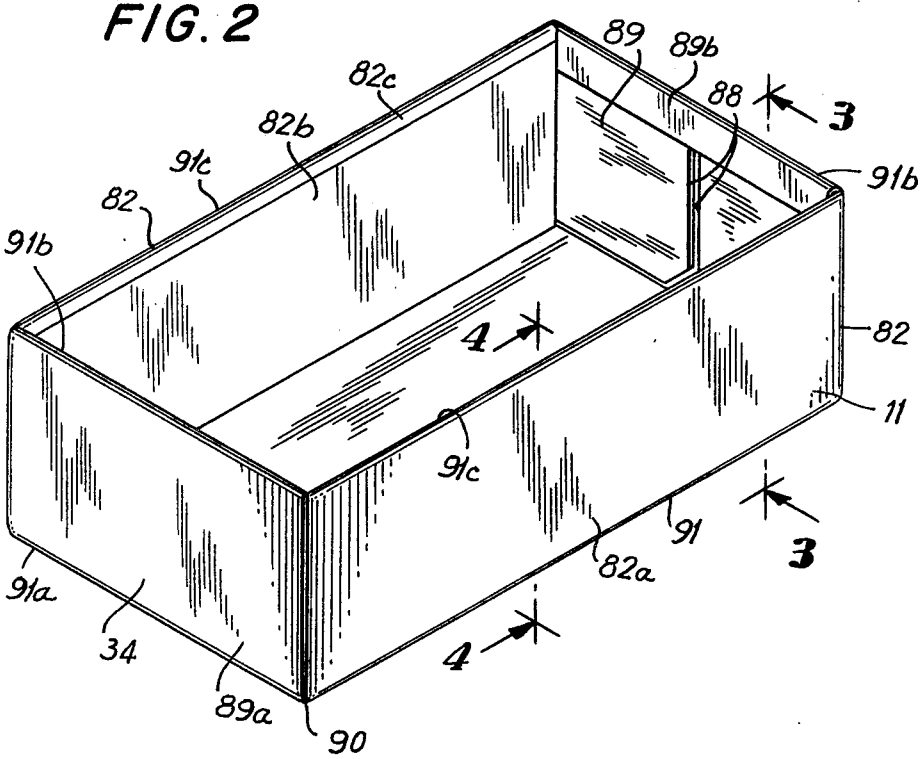
FIG. 2 is a perspective view of the assembled box, illustrating the interior thereof.

Referring now to FIG. 2, the box blank 10 is folded into an assembled box having double-layered side walls substantially in the following manner: The blank is turned over so that the reverse or unornamented side of the blank is uppermost. The blank is then folded along the lines of the creases 18 so that the two side panel flaps 20 are bent upwardly at right angles (from the plane of the paper as viewed in FIG. 1), and then downwardly through a total angle of 180°, so that the side panel flaps 20 overlie the side panels 16 in face-to-face contact. These portions may be permanently bonded to one another by the use of a conventional adhesive or glue, which may be applied prior to the commencement of the folding operation. Whatever pressure is required to adhere these portions is subsequently applied during the folding operation. In this manner, double-layered side walls 82 (see FIGS. 2 and 4) are formed from the overlying relationship of side panels 16 and side panel flaps 20, each side wall 82 having an exterior surface **82*a* which is completely covered by paper wrap 11, and an interior surface 82*b* which carries only a paper lip 82*c* formed by the edge portions 46 of paper wrap 11**.

Figure 4:
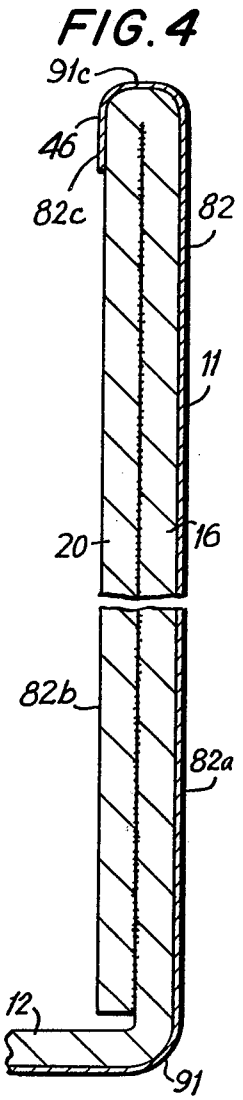
FIG. 4 is an enlarged cross-sectional view of a side wall of the box of FIG. 2, taken substantially along the lines 4—4 of FIG. 2.
Figure 3:
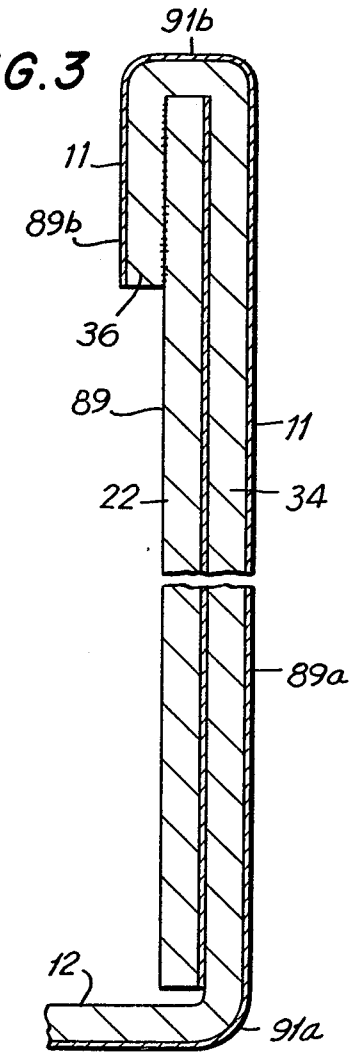
FIG. 3 is an enlarged cross-sectional view of an end wall of the box of FIG. 2, taken substantially along the lines 3—3 of FIG. 2.

In order to complete the assembly of the box, the blank 10 is then folded along the creases 26 so that the four side panel extensions 22 are bent upwardly at right angles (from the plane of the paper as viewed in FIG. 1). The blank is then folded along creases 14 so that the two side walls 82 are also bent upwardly at an angle of 90° to the central portion 12, as shown in FIGS. 2 and 4, and the edges 88 of each pair of side panel extensions 22 are joined, by means of a suitable adhesive, and at approximately the mid-point of their combined overall length, to form the interior end walls 89 of the box (see FIGS. 2 and 3).

Finally, the blank is folded along the creases 32 so that the two end panels 34 are bent upwardly at right angles to the central portion 12 to form the exterior end walls 89*a* of the box. A suitable adhesive is then applied to the inner surface of end panel extensions 36, and they are folded inwardly along creases 38 through an angle of 180° over the interior end walls 89 (see FIG. 3). Pressure may then be applied to assure the adherence of end panel extensions 36 to interior end walls 89. As shown best in FIGS. 2 and 3, end panel extensions 36, when folded into place, form end wall lips 89*b* which extend part of the way down from the top of the box along the interior end walls 89, covering only the upper portion of each interior end wall 89, and presenting a portion of paper wrap 11 on each interior end wall lip 89*b*.

After the foregoing steps have been executed, the folding operation will then be complete, yielding an assembled box 90 as illustrated in FIG. 2. It will be noted that the upper portion of the interior surfaces of side walls 82 and the upper portion of the interior surfaces of end walls 89 are covered with the same decorative paper wrap 11 which covers all of the exterior surfaces of the box 90, forming a substantially continuous paper wrap border on the four upper interior edges 91*b* and 91*c* of the box and thereby providing a pleasing finished appearance for the interior of the box. As shown clearly in FIG. 4, however, each side wall 82 is of double thickness all of the way down from the top of the box to the bottom of the box, thereby giving the box study, double-layered side walls 82.

Moreover, it will be seen from a comparison of FIGS. 1 and 2 that by folding the blank 10 in the manner set forth above, a shoe box 90 with sharply defined edges is formed. The two opposite lower side edges 91 of central portion 12 are formed by the folds along creases 14. Similarly, the opposite lower end edges 91*a* of central portion 12 are formed by the folds along creases 32.

The folding operation defines the rim of the box as well. Upper end edges 91*b* are formed by the folds along creases 36, while upper side edges 91*c* are formed by the folds along creases 18.

It may be seen from the foregoing, that the embodiments described herein are by way of illustration and not of limitation, and that various changes in and other modifications of the construction, composition, and arrangement of parts are possible in light of the above teachings. Accordingly, it is to be understood that other embodiments of this invention could be utilized without departing from the spirit and scope of the present invention as set forth in the appended claims.

I claim:

1. A foldable blank for forming a box, the blank comprising a rectangular central portion, a first pair of rectangular side panels located adjacent to a first pair of parallel opposed edges of the central portion and separated from the central portion by a first pair of fold lines, a second pair of rectangular side panels, each of said second pair of rectangular side panels being substantially equal in area to each of the first pair of rectangular side panels, said second pair of rectangular side panels being located on opposite sides of the central portion and separated from the first pair of side panels by a second pair of fold lines, two pairs of side panel extensions, each pair of side panel extensions being separated from one of the first pair of rectangular side panels by a third pair of fold lines, a pair of end panels located adjacent to a second pair of parallel opposed edges of the central portion and separated from the central portion by a fourth pair of fold lines, a pair of end panel extensions located on opposite sides of the central portion and separated from the end panels by a fifth pair of fold lines, the blank further comprising a decorative paper wrap covering one face of the central portion and extending to cover the co-planar faces of the end panels, the end panel extensions, the first pair of side panels and the side panel extensions and also extending to cover a margin of the co-planar face of the second pair of side panels, the blank being foldable to form upstanding side walls of double thickness, upstanding interior end walls, upstanding exterior end walls, and interior end wall lips overlapping the interior end walls, the paper wrap thereby extending over the entire exterior surface of the box, over each interior end wall lip of the box and forming a side wall upper margin on each interior side wall of the box, a substantially continuous paper wrap border being thereby formed on the four upper interior edges of the box, said border being comprised of a side wall upper margin on each of two opposed upper interior edges of the box and an interior end wall lip on each of two other opposed upper interior edges of the box.

2. A foldable blank in accordance with claim 1 wherein the decorative paper wrap is colored differently from the remaining exposed surfaces of the lank.

* * * * *